US006735840B2

(12) United States Patent
Gibbs

(10) Patent No.: US 6,735,840 B2
(45) **Date of Patent: *May 18, 2004**

(54) BURNISHING TOOL

(75) Inventor: Ronnie D. Gibbs, Bountiful, UT (US)

(73) Assignee: Megaware Keelguard, Inc., Ogden, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/262,652

(22) Filed: Mar. 4, 1999

(65) Prior Publication Data

US 2003/0188408 A1 Oct. 9, 2003

Related U.S. Application Data

(60) Provisional application No. 60/076,803, filed on Mar. 4, 1998.

(51) Int. Cl.[7] ..... B24B 39/00

(52) U.S. Cl. ..... 29/90.01; 29/81.17; 29/81.11; 15/236.07; D32/46

(58) Field of Search ..... 29/90.01, 81.16, 29/81.17, 81.11; 15/236.01, 236.02, 236.07, 236.05, 236.08, 143.1; D32/46; D8/14

(56) References Cited

U.S. PATENT DOCUMENTS

| | | | | | |
|---|---|---|---|---|---|
| 58,797 | A | * | 10/1866 | Mayhew | 188/15 |
| 1,018,844 | A | * | 2/1912 | Meyer | 15/236.01 |
| 1,211,062 | A | | 1/1917 | Bowman | |
| 1,768,411 | A | * | 6/1930 | Lord | 15/235.4 |
| 1,898,690 | A | | 2/1933 | Schacht | |
| D128,654 | S | * | 8/1941 | Jobst | D4/138 |
| D170,415 | S | * | 9/1953 | Jaderborg | D2/642 |
| 3,409,982 | A | * | 11/1968 | Baker et al. | 30/47 |
| 3,411,723 | A | * | 11/1968 | Kohn | 15/236.01 |
| D221,036 | S | * | 6/1971 | Potti | D24/149 |

(List continued on next page.)

*Primary Examiner*—Gregory Vidovich
*Assistant Examiner*—Marc Jimenez
(74) *Attorney, Agent, or Firm*—Pate Pierce & Baird

(57) ABSTRACT

A burnishing tool is disclosed in one presently preferred embodiment of the present invention as including a first end, a second opposing end, and an elongated intermediate portion disposed between the first and second ends. The intermediate portion of the burnishing tool is formed having a general arcuate configuration and includes a main body and a handle. The main body of the intermediate portion comprises a dimensional width greater than the dimensional width of the handle such that the burnishing tool fits comfortably and conveniently within the contour of a hand of a user. Specifically, the configuration of the burnishing tool facilitates sufficient surface area in the handle to facilitate gripping of the present invention and the application of sufficient compression force or pressure against the main body of the intermediate portion with the thumb and forefinger while using the palmar region of a user's hand to apply additional pressure in a controlled manner against the surface or substrate to which the main body or contoured leading edge is applied. Formed at the first end of the burnishing tool is a contoured leading edge. In structural design, the leading edge comprises a soft radius and rounded corners to prevent binding, marring, scratching, gouging, or the like in the surface facing of a substrate or surface upon application. In addition, the leading edge at the first end of the intermediate portion of the burnishing tool is preferably formed having one corner of the leading edge that dimensionally longer than an opposing corner of the edge.

18 Claims, 4 Drawing Sheets

U.S. PATENT DOCUMENTS

| | | | | | |
|---|---|---|---|---|---|
| 4,040,140 | A | | 8/1977 | Hopkins et al. | 15/236 R |
| D247,018 | S | * | 1/1978 | Kramer et al. | D8/14 |
| 4,290,539 | A | * | 9/1981 | Lowery | 223/118 |
| D264,043 | S | * | 4/1982 | Edwards | D8/31 |
| D273,078 | S | * | 3/1984 | Boreback | D8/31 |
| 4,495,668 | A | | 1/1985 | Adams | 15/105 |
| 4,536,910 | A | | 8/1985 | Clark | 15/104 S |
| D291,404 | S | * | 8/1987 | Cummings et al. | D8/107 |
| D297,801 | S | * | 9/1988 | Olsson | D8/14 |
| 4,779,301 | A | | 10/1988 | Millette | 15/105 |
| D311,981 | S | | 11/1990 | Kabbaby et al. | D32/46 |
| D312,379 | S | * | 11/1990 | Casab | D8/98 |
| 4,969,268 | A | * | 11/1990 | Kelly | 294/7 |
| 5,008,970 | A | | 4/1991 | Tsai | 15/236.01 |
| D318,157 | S | * | 7/1991 | Perior | D32/41 |
| 5,095,573 | A | | 3/1992 | Henke et al. | 15/105 |
| 5,272,782 | A | | 12/1993 | Hutt | 15/105 |
| 5,398,364 | A | * | 3/1995 | Vogt | 15/236.02 |
| D362,604 | S | * | 9/1995 | White et al. | D8/45 |
| D364,718 | S | | 11/1995 | Reuss | D32/46 |
| D372,349 | S | | 7/1996 | Adair | D32/49 |
| D387,629 | S | * | 12/1997 | Thierry | D7/688 |
| 5,706,553 | A | * | 1/1998 | Riley et al. | 15/236.01 |
| 5,749,117 | A | * | 5/1998 | Forsline | 15/245.1 |
| 5,759,628 | A | * | 6/1998 | Garcia, Jr. | 427/356 |
| D426,758 | S | * | 6/2000 | Mitchell | D8/14 |
| 6,223,801 | B1 | * | 5/2001 | Mitchell | 156/574 |
| D469,230 | S | * | 1/2003 | Libman et al. | D32/41 |

* cited by examiner

BURNISHING TOOL

RELATED APPLICATIONS

This application claims the benefit of U.S. Provisional Application No. 60/076,803, filed Mar. 4, 1998 and entitled BURNISHING TOOL.

BACKGROUND OF THE INVENTION

1. The Field of the Invention

This invention relates to the field of hand tools and, more particularly, to novel burnishing tools for smoothing or polishing a surface and for other applications requiring manipulation in the application of a substrate to an underlying surface by means of rubbing, compacting, smoothing, and/or turning an edge.

2. The Background Art

A variety of prior art spatula type devices have been developed by those skilled in the art which typically comprise a blade attached to a wood or plastic handle. The size and configuration of the blade is generally determined by the type of use for which the tool is intended (i.e., applying putty, drywall taping compound, plaster, spreading adhesives, etc.). For example, those skilled in the art developed spatula type scrapers designed to focus the scraping effort at the front of the scraper, thereby not wasting any scraping effort at the sides of the scraper. In particular, prior art spatula scrapers of this general type may comprise a sharpened front scraping edge and at least one sharpened cutting edge disposed at one end of the scraping edge. The cutting edge extends generally transverse to the scraping edge.

A significant disadvantage with spatula type scrapers of the prior art is that when applying downward pressure to the handle, scrapers tend to flex excessively at the transition between the blade and the handle wherein that general area becomes a potential point of structural failure under excessive force. In this regard, those skilled in the art developed spatula hand tools that include an integrally molded handle and blade having a reinforcing blister formed along the longitudinal axis of the tool across a transition area disposed between the handle and the blade. Specifically, the handle portion may be formed having a reduced thickness by providing a peripheral ridge that extends through the transition area between the handle and blade and onto the surface of the blade.

As appreciated, those skilled in the art also developed hand-held scrapers for removing ice and snow from windshields and the like. Typically, hand-held ice scrapers comprise a scraper blade formed at one end of the scraper providing a sharp scraping edge. Prior art ice scrapers may further include a pliable, polymeric sheath that envelops the handle portion of the scraper at the end opposite the scraping blade so as to cover about two-thirds of the linear extent of the ice scraper to serve as a protective hand grip.

Hand-held ice scrapers of the prior art may also be formed having a three-bladed squeegee/scraper/polisher insert constructed from a flat, soft blade (e.g., formed of rubber or a soft plastic), a blade of intermediate flexibility, and a blade having stiffer characteristics. Each of the individual blades may be rotatably disposed relative to the scraping end of the scraper by means of a fastener disposed in relation to a narrowed portion of the body of the ice scraper. In operation, the various blade implements can be rotated into engagement or out of the way depending on the type of precipitation to be removed.

Although several attempts have been made to address the disadvantages associated with the excessive flexibility of prior art spatula type scrapers and the various design and redesigns of prior art ice scrapers that have been developed by those skilled in the art, significant problems continue to exist when attempting to use prior art spatula type devices or ice scrapers for smoothing or polishing a surface or for other applications requiring the manipulation of a substrate in relation to an underlying surface (e.g., by means of rubbing or applying pressure to remove air bubbles between the substrate and the surface in order to accommodate a proper "wet out" of the substrate relative to the surface). Specifically, prior art spatulas and hand-held ice scrapers generally do not allow for the constant application of a force or pressure against a surface to achieve an adequate "wet out" between the substrate and the underlying surface. Because these prior art devices are usually designed with sharp, abrupt edges for scraping across a surface, when they are used for the purpose of burnishing, prior art spatula type devices and hand-held ice scrapers generally cause binding, marring, scratching, gouging, or the like in the facing of a substrate or surface to which the substrate is being applied.

To alleviate the disadvantages associated with prior art spatulas and ice scrapers being used for burnishing surfaces or in the application of a substrate to an underlying surface, those skilled in the art developed application rollers that are typically disposed in operable relation to a support frame in a rotatable relationship therewith. Although prior art application rollers generally afford meaningful advantages over traditional spatula type devices and hand-held ice scrapers, the overall effectiveness of such prior art application rollers has been questioned in view of providing limited surface area pressure against the substrate and/or underlying surface to which the substrate is being applied. Similarly, prior art application rollers are generally unable to transfer sufficient pressure and control to compound radii and/or curvatures of a substrate or the underlying surface. It would be desirable, therefore, to provide an improved burnishing tool which realizes the advantages of the various prior art scrapers while at the same time eliminating the disadvantages associated therewith. Such a burnishing tool is disclosed and claimed herein.

BRIEF SUMMARY AND OBJECTS OF THE INVENTION

In view of the foregoing, it is a primary object of the present invention to provide novel burnishing tools for smoothing, pressing, laminating, spreading, rubbing, or compacting a surface and/or for other applications that require the manipulation of a substrate in relation to an underlying surface by means of smoothing, pressing, laminating, pressing, rubbing, compacting, and/or turning an edge.

It is also an object of the present invention to provide a burnishing tool which has a contoured leading edge having a soft radius that eliminates binding, marring, scratching, gouging, or the like in the facing of a surface or substrate to which the contoured leading edge of the present invention is applied.

Further, it is an object of the present invention to provide a burnishing tool having a novel structural design for applying an even pressure or force against a substrate and underlying surface to remove air bubbles therebetween and thereby facilitate a proper adhesive "wet out" or bond between the substrate and the underlying surface.

It is a still further object of the present invention to provide a burnishing tool which comprises a configured body that fits comfortably and conveniently within the contour of a user's hand. Specifically, the novel configuration of the burnishing tool provides sufficient surface area in the palmar region of the hand to facilitate a means for gripping the present invention with the thumb and forefinger thus using the palmar region of the hand to apply sufficient pressure in a controlled matter to the surface or substrate to which the burnishing tool is applied and over the compound radii and/or curvatures encountered.

In addition, it is an object of the present invention to provide a novel burnishing tool comprising an elongated body that allows for slight flexing without memory retention.

Still another object of the present invention is to provide a burnishing tool which simplifies the burnishing process and which is easy to use, economically viable, and relatively trouble free in operation.

It is a still further object of the present invention to provide a burnishing tool which is simple in construction and efficient in operation.

Consistent with the foregoing objects, and in accordance with the invention as embodied and broadly described herein, a burnishing tool comprises a first end, a second opposing end, and an elongated intermediate portion disposed between the first and second ends. The intermediate portion of the burnishing tool is preferably formed having an arcuate configuration and includes a main body and a handle. The main body of the intermediate portion comprises a dimensional width greater than the dimensional width of the handle so as to fit comfortably and conveniently within the contour of the hand of a user. Specifically, the novel configuration of the burnishing tool facilitates sufficient surface area in the handle to facilitate a means for gripping the present invention and applying sufficient compression force or pressure against the main body of the intermediate portion with the thumb and forefinger of the user while using the palmar region of the hand to apply additional pressure in a controlled manner against a substrate or surface to which the main body or contoured leading edge is applied.

At the first end of the burnishing tool is a contoured leading edge. In structural design, the leading edge comprises a soft radius preferably having rounded corners to prevent binding, marring, scratching, gouging, or the like in the facing of a surface or substrate to which the leading edge is being applied. The contoured leading edge formed at the first end of the intermediate portion of the burnishing tool may also be formed having one corner of the leading edge dimensionally longer than an opposing corner of the leading edge.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DESCRIPTION OF THE PREFERRED EMBODIMENT

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
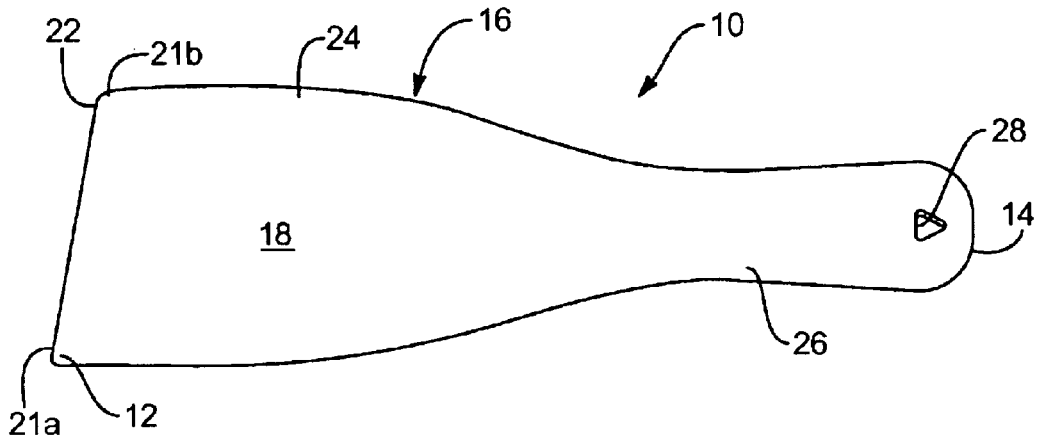
FIG. 1 is a top plan view of a burnishing tool in accordance with one presently preferred embodiment of the present invention.
Figure 2:
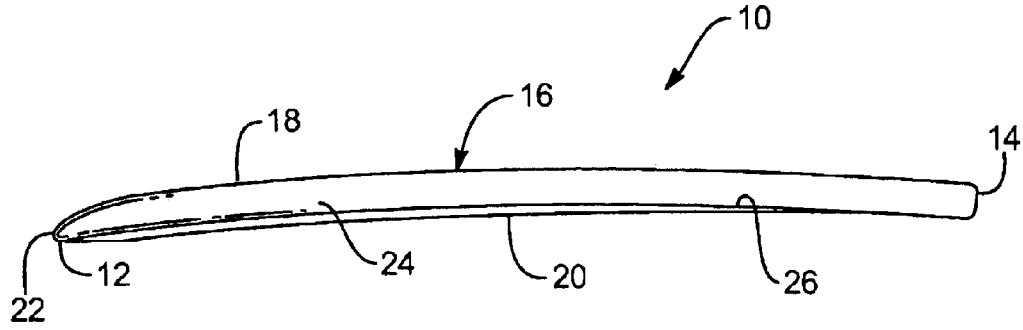
FIG. 2 is a side view of one presently preferred embodiment of the burnishing tool illustrated in FIG. 1.
Figure 3:
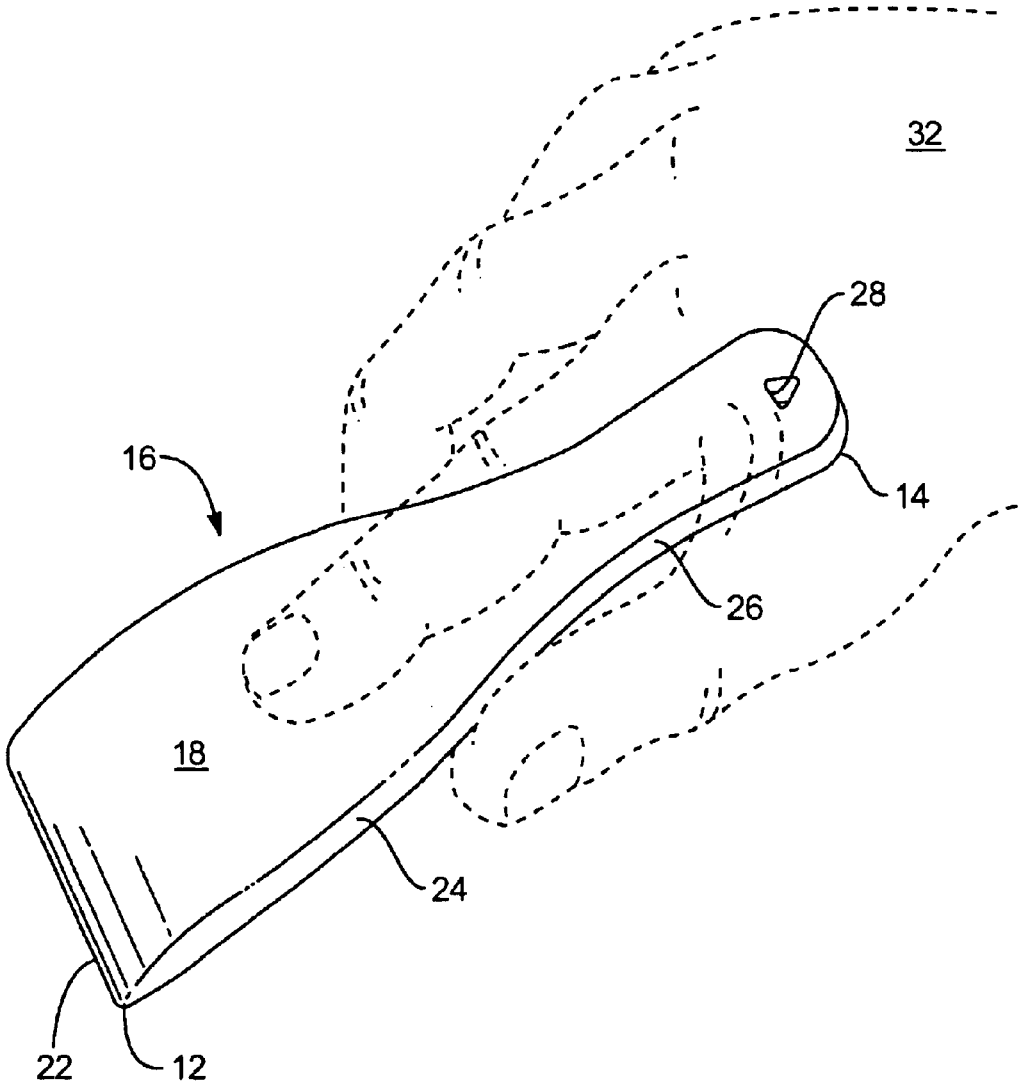
FIG. 3 is a perspective view of one presently preferred embodiment of the burnishing tool shown in use by a user.
Figure 4:
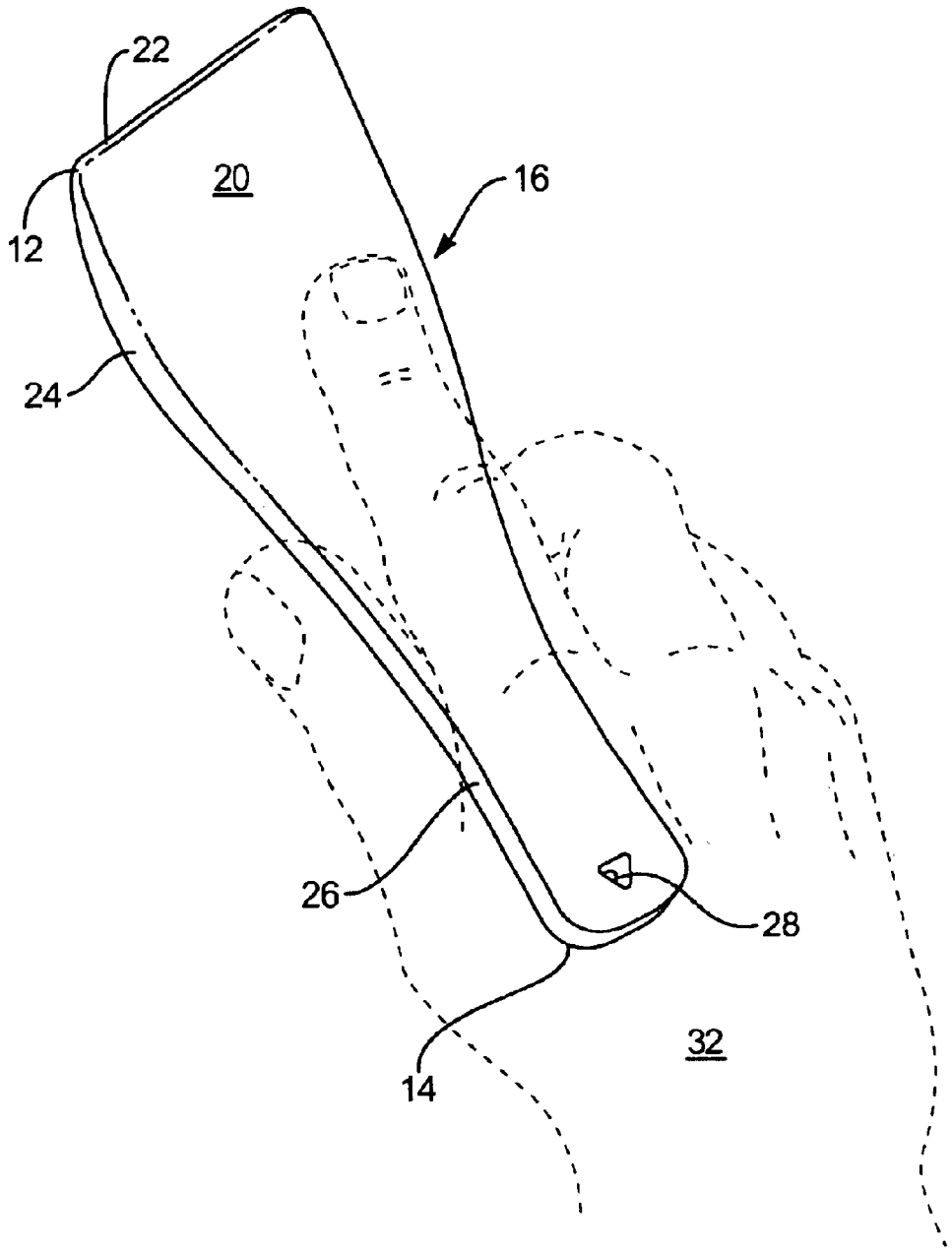
FIG. 4 is a perspective view of one presently preferred embodiment of the burnishing tool illustrated in use by a user in an inverted position to that shown in FIG. 3.

One presently preferred embodiment of the present invention, designated generally at 10, is best illustrated in FIGS. 1, 2, and 3. As shown, a burnishing tool 10 comprises a first end 12, a second opposing end 14, and an elongated intermediate portion 16 disposed between the first and second ends 12, 14. The intermediate portion 16 of the burnishing tool 10 is formed having an overall general arcuate configuration, as best shown in FIG. 2. In addition, the intermediate portion 16 includes a main body 24 and a handle 26.

Referring now to FIGS. 1 and 3, the main body 24 of the intermediate portion 16 preferably comprises a dimensional width greater than the dimensional width of the handle 26 so as to fit comfortably and conveniently within the contour of a user's hand 32. In preferred design, the dimensional width of the main body 24 begins to taper from the first end 12 of the burnishing tool 10 to a point in which the dimensional width of the intermediate portion 16 equals that of the corresponding portion of the handle 26.

Figure 5:
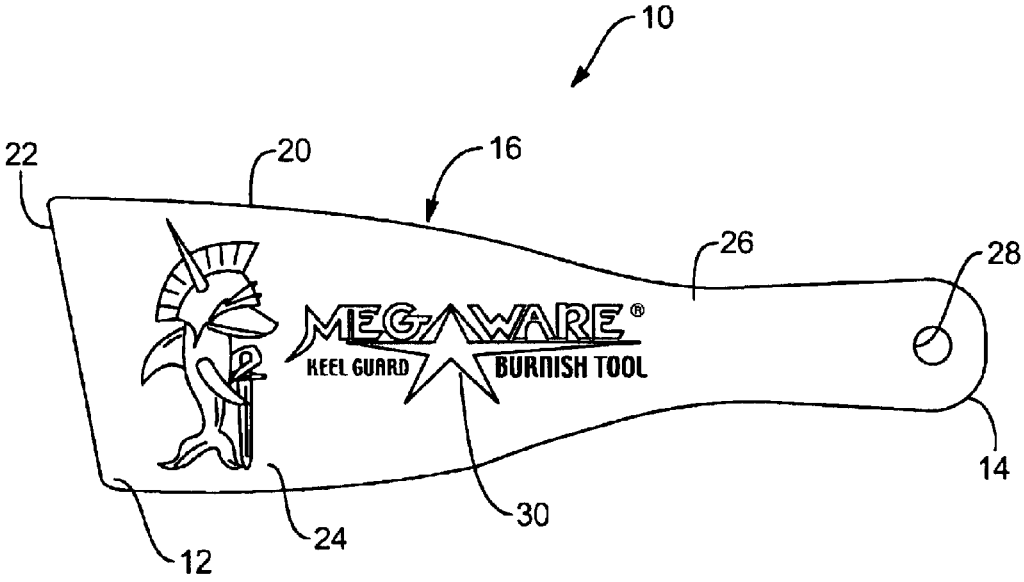
FIG. 5 is a top plan view of one presently preferred embodiment of a burnishing tool of the present invention which illustrates the incorporation of a design logo on a surface facing of the intermediate portion of the burnishing tool.

In one presently preferred embodiment of the present invention, the dimensional width at the first end of the main body 24 is preferably about 5.5 cm and the dimensional width of the handle 26 at the point where the dimensional width of the main body 24 corresponds is preferably about 2.2 cm. As best shown in FIGS. 1 and 5, the dimensional width of the second end 14 of the burnishing tool is slightly larger than the dimensional width of the handle 16. For example, the dimensional width at the second end 14 is preferably approximately 2.5 cm.

The dimensional length of the intermediate portion 16 of the burnishing tool 10 between the first and second ends 12, 14 is between approximately 12.5 cm and 25 cm, and preferably about 17.5 cm. Correspondingly, the intermediate portion 16 comprises a general uniform thickness of between approximately 0.5 cm and 0.10 cm., and preferably about 0.7 cm.

Consistent with the forgoing dimensional relationships of the burnishing tool 10, the novel configuration of the burnishing tool 10 facilitates sufficient surface area in the handle 26 to facilitate means for gripping the present invention and applying sufficient compression force or pressure against the main body 24 of the intermediate portion 16 with the thumb and forefinger while using the palmar region of the hand 32 to apply additional pressure in a controlled manner against the surface or substrate to which the main body or contoured leading edge is applied. Moreover, the crowned intermediate portion 16 allows for more flexibility in the burnishing tool 10 without memory retention.

Formed at the first end 12 of the burnishing tool 10 is a leading edge 22. In structural design, the leading edge 22 comprises a soft radius to prevent binding, marring, scratching, gouging, or the like in the surface facing of a substrate or surface to which the leading edge 22 of the burnishing tool 10 is being applied. In one presently preferred embodiment of the present invention, the leading edge 22 comprises an angle of between approximately 20° and 40°, and preferably between about 25° and 30°. The contoured leading edge 22 of the burnishing tool may also incorporate rounded corners, if desired.

Referring now to FIG. 1, the leading edge 22 at the first end 12 of the intermediate portion 16 of the burnishing tool 10 may be formed having one corner 21*a* of the edge dimensionally longer in relation to an opposing corner 21*b* of the leading edge. In one presently preferred embodiment of the present invention, the radius along the leading edge 22 is preferably formed having a radius of between approximately 0.08 cm and 0.47 cm, and preferably about 0.31 cm. Consistent therewith, the external edges of the leading edge 22 may be formed comprising a radius of between approximately 0.15 cm and 0.625 cm, and preferably about 0.23 cm.

Disposed contiguous to the second end 14 of the burnishing tool 10 is a retaining aperture 28. As shown in FIGS. 1, 3, 4, and 5, the retaining aperture 28 comprises an internal periphery sufficient for being mountably disposed in relation to a conventional fastener (e.g., nail, bolt, screw, etc.). The retaining aperture 28 may provide an internal periphery where through a section of cordage may be introduced and secured thereto. The cordage securely attached to the retaining aperture 28 may then be retained by means of a conventional fastener (e.g., nail, bolt, screw, etc ). Those skilled in the art will readily recognize other possible modifications and adaptations which are consistent with the spirit and scope of the present invention.

In one presently preferred embodiment of the present invention, an upper surface 18 and a lower surface 20 are formed having a substantially smooth surface, which, as used herein, means that the surfaces are substantially free from roughness and projections. Referring now to FIG. 5, an identifying mark 30 (e.g., design, slogan, logo, trademark, etc.) may be incorporated in the lower surface 20 of the burnishing tool 10, if desired. As will be readily appreciated, an identifying mark 30 may be incorporated in the upper surface 18 of the burnishing tool 10, although not specifically illustrated in the figures.

The burnishing tool 10 of the present invention is formed of a substantially sturdy material having sufficient structural integrity to withstand normal forces applied against a surface or substrate when undergoing burnishing techniques. In one presently preferred embodiment of the present invention, the burnishing tool 10 is formed of any of numerous organic, synthetic, or processed materials that are mostly thermoplastic or thermosetting polymers of high molecular weight with or without additives, such as, plasticizers, auto oxidants, extenders, colorants, ultra-violet light stabilizers, or fillers, which can be shaped, molded, cast, extruded, drawn, foamed, or laminated. It will be readily appreciated by those skilled in the art, however, that the burnishing tool 10 may be formed of wood, ceramic, fiberglass, graphite, metal, or other polymeric or composite materials which are consistent with the spirit and scope of the present invention.

Consistent with the foregoing, it will be apparent that various other dimensional sizes and/or configurations of the burnishing tool 10 and its component parts may be constructed in accordance with the inventive principles set forth herein. It is intended, therefore, that the examples provided herein be viewed as exemplary of the principles of the present invention, and not as restrictive to a particular structure, embodiment, or dimension for implementing those principles.

From the above discussion, it will be appreciated that the present invention provides novel burnishing tools for smoothing, pressing, laminating, spreading, rubbing, or compacting a surface and/or for other applications requiring the manipulation of a substrate to an underlying surface by means of smoothing, pressing, laminating, spreading, rubbing, compacting, and/or turning an edge. In particular, the present invention provides a contoured leading edge having a soft radius which eliminates binding, marring, scratching, gouging, or the like in the facing of the surface or the substrate to which the main body or contoured leading edge is applied.

Unlike prior art devices, the present invention provides a burnishing tool having a novel structural design for applying an even pressure force to remove air bubbles and facilitate a proper adhesive "wet out" or bond between a substrate and an underlying surface. Additionally, the present invention comprises a body configuration sufficient for fitting comfortably and conveniently within the contour of a user's hand. In particular, the shape of the burnishing tool of the present invention provides sufficient surface area in the handle to facilitate a means for gripping the present invention and sufficient surface area in the main body to apply the thumb and forefinger and using the palmer region of the hand to apply sufficient pressure in a controlled manner to the surface or the substrate to which it is applied. Consistent with the foregoing, the burnishing tool of the present invention comprises an elongated contoured body which allows for slight flexing without memory retention. Moreover, the present invention simplifies the burnishing process and is simple in construction and efficient in operation.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A tool for applying a compressive force against a first surface to conform said first surface to a second underlying surface, said tool comprising:

a first end, a second end, and an elongated portion extending from said first end to said second end, said elongated portion being formed of a substantially rigid material having little flexure to have an upper surface, a lower surface, and an arcuate configuration consisting of a single arc defined by said upper and lower surfaces;

said elongated portion comprising a body section having a first length and a first average width and a handle section having a second length and a second average width, wherein said first length of said body section is greater than said second length of said handle section wherein said handle section at the second end is configured to be received within the base of a user's hand with at least one finger of the hand on the body section; and a substantially linear leading edge formed at said first end, said leading edge having a soft radius providing a smooth transition between said upper and lower surfaces of said elongated portion, wherein said soft radius is suitable to prevent binding, marring, scratching and gouging in said first surface.

2. A tool as defined in claim 1, wherein the first average width is greater than the second average width.

3. A tool as defined in claim 2, wherein said body section tapers in width to meet said handle section.

4. A tool as defined in claim 3, wherein said body section has a width at said first end of about 5.5 cm.

5. A tool as defined in claim 3, wherein a minimum width of said handle section is about 2.2 cm.

6. A tool as defined in claim 5, wherein a maximum width of the handle section is about 2.5 cm.

7. A tool as defined in claim 1, wherein the total length of said elongated portion is between 12.5 cm and 25 cm.

8. A tool as defined in claim 1, wherein said elongated portion comprises a general uniform thickness.

9. A tool as defined in claim 8, wherein said general uniform thickness is between 0.5 cm and 0.10 cm.

10. A tool as defined in claim 1, wherein said leading edge comprises an angle of between 20° and 40°.

11. A tool as defined in claim 1, wherein said leading edge comprises a radius of between 0.08 cm and 0.47 cm.

12. A tool as defined in claim 1, further comprising a retaining aperture.

13. A tool as defined in claim 1, wherein said upper surface comprises an identifying mark.

14. A burnishing tool, comprising:

an elongated portion being formed of a substantially rigid material having little flexure and having a first end, a second end, an upper surface and a lower surface, said elongated portion having an arcuate configuration consisting of a single arc defined by said upper and lower surfaces;

said first end having a substantially linear leading edge comprising a soft radius providing a smooth transition between said upper and lower surfaces and suitable to prevent binding, marring, scratching, and gouging; and said elongated portion having a body portion characterized by a first length and a first average width, and a handle portion characterized by a second length and a second average width, wherein said first length of said body section is greater than said second length of said handle section, wherein said handle portion, at the second end is configured to be received within the base of a user's hand with at least one finger of the hand on the body portion.

15. The burnishing tool of claim 14, wherein said first average width is greater than said second average width.

16. The burnishing tool of claim 15, wherein said body portion provides said leading edge.

17. The burnishing tool of claim 16, wherein said handle portion is configured to fit within the palm of a user to transmit a force from the user to said leading edge of said body portion.

18. The burnishing tool of claim 17, wherein said first average width is selected to provide a gripping area for the thumb and fingers of said user.

* * * * *

UNITED STATES PATENT AND TRADEMARK OFFICE

CERTIFICATE OF CORRECTION

PATENT NO. : 6,735,840 B2
DATED : May 18, 2004
INVENTOR(S) : Ronnie D. Gibbs

It is certified that error appears in the above-identified patent and that said Letters Patent is hereby corrected as shown below:

Column 4,
Line 54, please delete "tool is", please insert therefore -- tool 10 is --.

Column 7,
Lines 3 and 4, please delete "section wherein", please insert therefore -- section, wherein --.
Line 4, please delete "section at", please insert therefore -- section, at --.
Line 4, please delete "end is", please insert therefore -- end, is --.

Column 8,
Line 20, please delete "end is", please insert therefore – end, is --.

Signed and Sealed this

Fourth Day of January, 2005

JON W. DUDAS
*Director of the United States Patent and Trademark Office*